United States Patent [19]

Lee

[11] 3,958,290

[45] May 25, 1976

[54] FEEDING DEVICE FOR THE ROTARY DIE HEAD OF AN AUTOMATIC HIGH-SPEED COLD HEADING MACHINE

[76] Inventor: Yuan Ho Lee, 85, Jen Ho Road, Tainan, China /Taiwan

[22] Filed: Mar. 14, 1975

[21] Appl. No.: 558,313

[52] U.S. Cl. ..... 10/13

[51] Int. Cl.[2] ..... B21K 1/44

[58] Field of Search ..... 10/11 R, 11 A, 12 R, 10/12.5, 13, 15

[56] References Cited

UNITED STATES PATENTS

| | | | |
|---|---|---|---|
| 1,637,107 | 7/1927 | Dwyer et al. | 10/13 |
| 1,712,259 | 5/1929 | Davis | 10/13 |
| 3,245,097 | 4/1966 | Domingo | 10/13 |

*Primary Examiner*—Lowell A. Larson
*Assistant Examiner*—E. M. Combs
*Attorney, Agent, or Firm*—Lane, Aitken, Dunner & Ziems

[57] ABSTRACT

The disclosed invention relates to a feeding device for a rotary die head of an automatic highspeed cold heading machine adapted for forming bolts, machine screws, rivets, and like products and, more particularly, to an intermittent rotary motion mechanism consisting principally of one or two pairs of cam gears and an epicyclic train of gears for transmitting an intermittent rotary motion to the rotary die head of the heading machine.

5 Claims, 5 Drawing Figures

FEEDING DEVICE FOR THE ROTARY DIE HEAD OF AN AUTOMATIC HIGH-SPEED COLD HEADING MACHINE

BACKGROUND OF THE INVENTION

In the prior art, the feeding devices of heading machines are generally provided with ratchet wheel and pawl mechanisms pivoted upon the body of the rotary die head. In addition, a friction device is mounted upon the transmission link on the die head to produce a feeding motion of the pitches between two consecutive dies. Such known devices have a number of disadvantages and are excessively complex in construction. Moreover, devices of this type are limited in output because of the vibration and abrupt impact to which they are subject at the moment of starting and stopping.

SUMMARY OF THE INVENTION

The invention provides an improvement in overcoming the defects mentioned above. In particular this invention provides a durable and simply constructed feeding device for the rotary die head of an automatic high-speed cold heading machine, and enables a significant increase in production. More particularly, this invention is accurate in operation and easily adjusted, thus eliminating the need for highly skilled operators in order to a speedy and stable heading operation.

BRIEF DESCRIPTION OF THE DRAWINGS

The invention is illustrated in the accompanying drawings, in which.

DETAILED DESCRIPTION OF THE EMBODIMENTS

Figure 1:
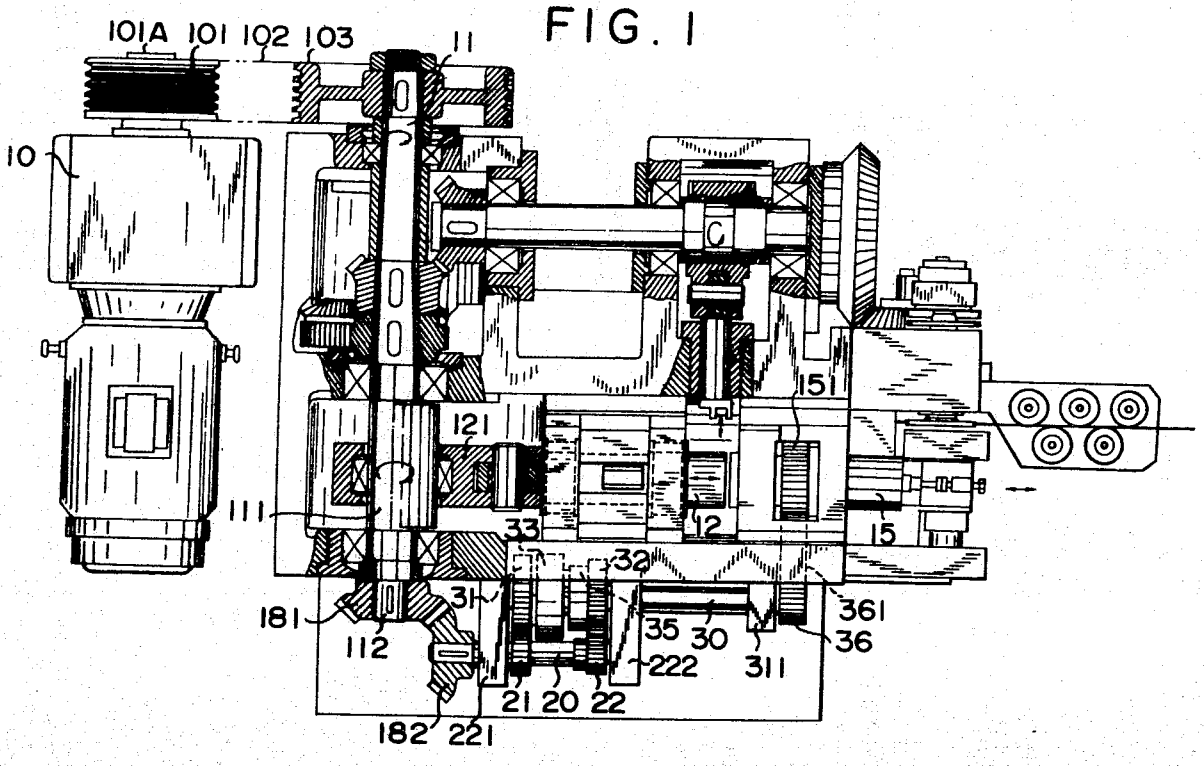
FIG. 1 depicts a plan view of the rotary heading machine partially in cross section.

The embodiment of FIG. 1 illustrates a simply constructed rotary heading machine according to the present invention wherein a V-belt pulley 101 is keyed to the driving shaft 101A of a motor 10 to drive a second V-belt pulley 103 via a V-belt 102. The second V-belt pulley 103 is in turn keyed to one end of the main eccentric shaft 11 of the cold heading machine to serve as the major source of power driving the main eccentric shaft 11. A first bevel gear 181, projecting from the machine body, is keyed to the other end 112 of the eccentric shaft 11. The driving power is then transmitted from the bevel gear 181 to a second bevel gear 182 affixed to a driven shaft 20 and further extended to shafts 20 and 30 by two pairs of gears 21, 31 and 22, 32 respectively, and the epicyclic train of gears 33, 35. The rotary die head 15 is thus able to revolve one pitch between two consecutive dies through a gear 36, an idle gear 361 and a gear 151.

During this operation, the eccentric shaft 11 is also transmitting driving power to a connecting rod 121 and thus to the punch head 12 to actuate the rotary die head 15. Reference numerals 221, 222 and 311 designate brackets mounted in the body of the heading machine.

In the following embodiments, like reference numerals are employed for like structure as previously described in connection with FIG. 1.

Figures 2, 5:
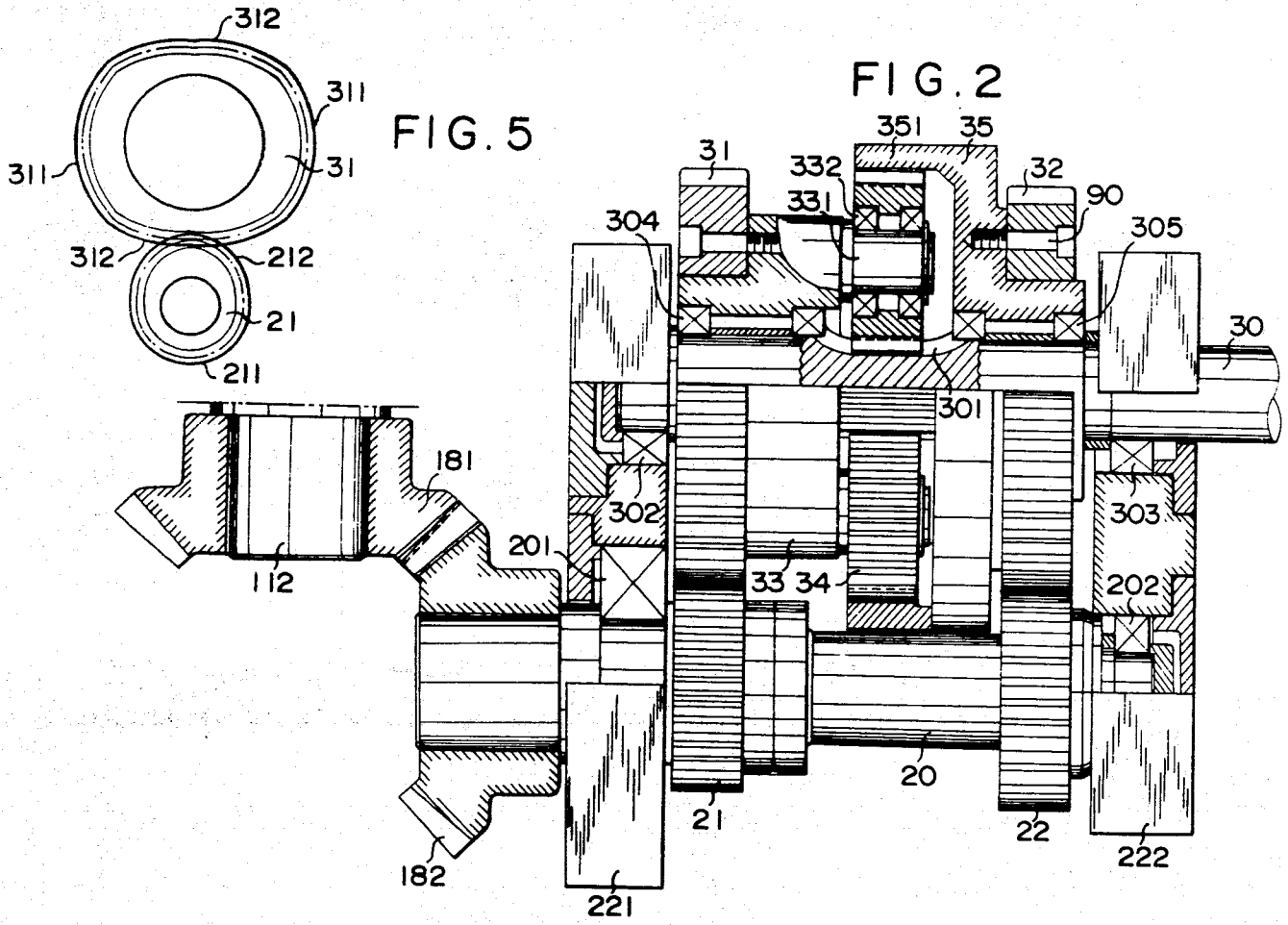
FIG. 2 depicts a partial cross-sectional view of a first embodiment of the feeding device of the present invention.
FIG. 5 is a front elevational view of a pair of cam gears of the feeding device of the present invention.

In FIG. 2, a first embodiment of the intermittent rotary motion feeding device of the present invention, is shown, wherein two pairs of meshing gears 21, 31 and 22, 32 are assembled at suitable positions on the axes of both the driving and the driven shafts 20 and 30 with equal center-to-center distances.

One pair of the meshing gears 21, 31 are located at one side of the shafts 20 and 30 and are cam-shaped. The second pair of the meshing gears 22, 32 are located at the opposite side of said shafts 20, 30 and are either spur or cam gears. The cam gear 21 is keyed to the driving shaft 20, while the corresponding mating gear 31 is fastened to one side of the rotary wheel 33 which is pivotedly mounted upon the driven shaft 30 by means of bearings 304 and 305. The mating gear 31 is positioned at one side of a ring gear 35. The rotary wheel 33 includes at least two extending shafts 331 to pivotally connect by bearings 332 with a plurality of planet gears 34. The rotary wheel 33 is thus able to rotate when the driving shaft 20 is rotated.

Moreover the gear 32 of the second pair of meshing gears is affixed to the opposite side of the ring gear 35 by bolts 90, of which only one is shown, and the ring gear 35 is meshed together with the planet gears 34 at the position indicated by reference numeral 351. A sun gear 301 is fixed to the driven shaft 30 and is meshed with the planet gears while 34 the bearings 302, 303 and 201, 202 support the driven and driving shafts 30 and 20 respectively. The eccentric shaft 11, the bevel gears 181, 182 and the brackets 221, 222 are the same as those mentioned in connection with FIG. 1. The first embodiment of the intermittent rotary motion feeding device used in the heading machine is stated hereinbefore.

Referring now to FIGS. 1, 2 and 5, when the main eccentric shaft 11 is caused to rotate by the drive power provided from the main driving motor 10, the driving shaft 20 of the feeding device will be caused to rotate by engagement with the mating bevel gears 181, 182. Simultaneously, the corresponding meshed gears 31, 32 will be actuated to rotate by engagement with the cam gear 21 and the cam or spur gear 22. The and the planet gears 34 and the ring gear 35 are actuating to revolve around the sun gear 301 by the engagement of the rotary wheel 33 with its extending shafts 331. Because the cam gear pair 21 and 31 are cam shaped, the revolving speed of the planet gears 34 and the ring gear 35 is the same (that is the relative speed is zero) at the running position of the diameters 211, 311 meshed by the pair of cam gears 21, 31 as illustrated in FIG. 5, at the time the running position changes to the diameters 212, 312 of the pair of cam gears 21, 31, the relative speed between the planet gears 34 and the ring gear 35 is changed thereof, (that is, the relative speed is not zero, and a differential speed is formed). The sun gear 301 and driven shaft 30 thus are rotated for one pitch by virtue of the differential speed until the running position returns to the diameters of 211, 311 of the gear pairs 21, 31. An intermittent rotary motion with a periodical dwell-and-moving motion of said die head 15 is therefore obtained through the driven shaft 30, the gear 36, the idle gear 361 and the fixed gear 151.

Figure 3:
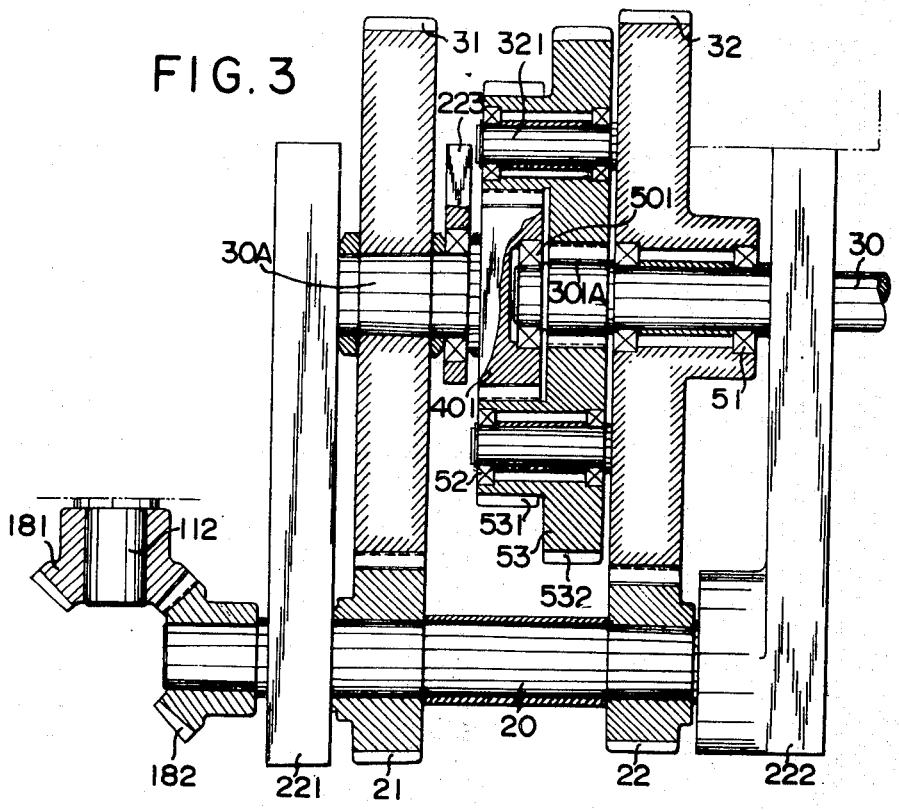
FIG. 3 depicts a partial cross-sectional view of a second embodiment of the feeding device of the present invention.

FIG. 3 shows a second embodiment of the intermittent rotary motion feeding device in the heading machine according to the present invention wherein the driven shaft is divided in two parts identified by reference numerals 30 and 30A, which are mounted together along a horizontal axis. The first driven shaft 30 is the same as in the first embodiment mentioned above. A cam or spur gear 32 is pivotally mounted on the first driven shaft 30 by bearings 51 and consists of at least two extending shafts 321—321 which are pivotally affixed to a step gear 53 and a sun gear 301A. The second driven shaft 30A is pivotally affixed to the brackets 221, 223 by bearings (not shown) and consists of a spur gear 401 which receives the first driven shaft 30 by a bearing 501 meshing with the pinion portion 531 of said step gear 53. A larger diameter portion 532 of said step gear 53 is meshed with the sun gear 301A. The construction and the action of other elements of this embodiment, for example, driving shaft 30, one pair of cam gears 21, 31 and the other pair of either cam or spur gears 22, 32, the bevel gears 181, 182 and one end 112 of the eccentric shaft are the same as that set forth in the first embodiment. Thus, detailed description is omitted. The first driven shaft 30 is rotated to transmit the die head 15 (see FIG. 1) for one pitch at the running position of the diameters 212, 312 (see FIG. 5) of the pair of cam gears 21 with 31 until the running position changes to the diameters 311, 411 of the pair of cam gears 21 with 31.

Figure 4:
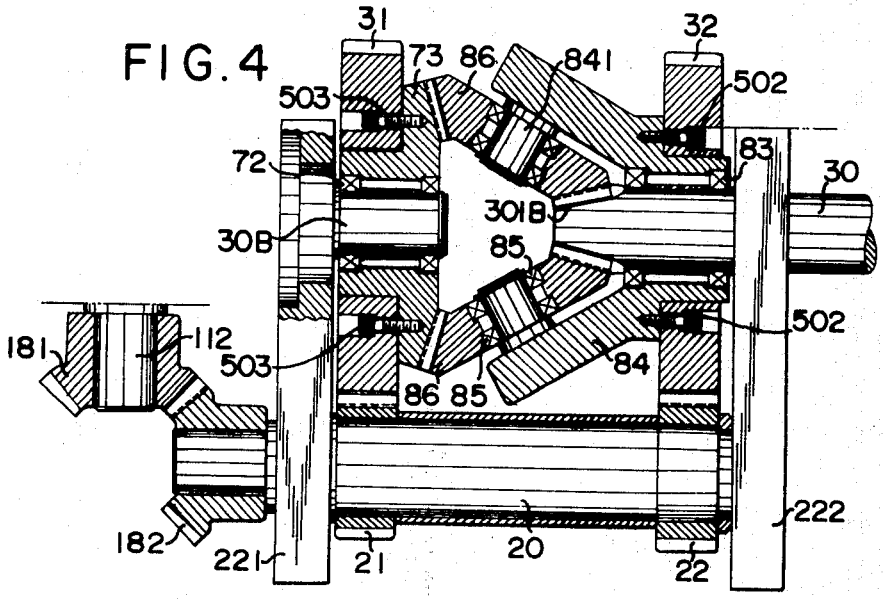
FIG. 4 depicts a partial cross-sectional view of a third embodiment of the feeding device of the present invention.

As illustrated in FIG. 4, a third embodiment of the intermittent rotary motion feeding device in the heading machine according to the present invention. The main feature is identical to the first embodiment with only several elements being slightly different. For example, the driven shaft is also divided into two portions 30 and 30B. A cone rotary wheel 84 is affixed to the gear 32 by means of bolts 502—502 and is pivotally affixed to the first driven shaft 30 by bearings 83. The cone rotary wheel 84 consists of at least two extending shafts 841 which are pivotally affixed to a first bevel gear 86 by bearings 85-85, one end of which is affixed to a sun gear 301B which is, in turn, affixed to the first driven shaft 30. The opposite end of the first bevel gear 86 is meshed with a second bevel gear 73 which is pivotally affixed to the second driven shaft 30B by means of bearings 72 and attached to the cam gear 31 by bolts 503—503. At the running position of diameters 212, 312 meshed by the pair of cam gears 21 with 31, the first driven shaft 30 will be rotated for one predetermined pitch by virtue of the differential speed between the first and the second bevel gear 86, 73 through the transmissions of one pair of cam gears 21 with 31, the other pair of either cam or spur gears 22 with 32 and the cone rotary wheel 84 until the running position changes to the diameters 211, 311 of the pair of cam gears 21 with 31. At that time, the first driven shaft 80 will then be stopped. An intermittent rotary motion with a periodical dwell-and moving of the die head 15 is produced through the transmission of said drive shaft 30 since the main motor 10 is running continuously.

While the embodiments of the invention have been described in detail, it will be obvious to those skilled in the art that the invention is capable of modification and variation without departing from the spirit and scope of the claims.

What is claimed is:

1. In a heading machine, the combination of:

a source of power;

an eccentric shaft operatively connected to be driven by said source of power;

a connecting rod operatively connected to said eccentric shaft;

a rotary die head, including a plurality of dies, actuated by said connecting rod;

an intermittent rotary feeding means operatively connected to said eccentric shaft for providing an intermittent rotary motion to said rotary die head, said feeding means including an epicyclic train of gears, a driving shaft, a driven shaft, and at least two pairs of gears arranged so that said epicyclic train of gears is connected by said two pairs of gears at an equal center-to-center distance between said driving shaft and said driven shaft, at least one pair of said two pairs of gears being cam gears which cooperate with said epicyclic train of gears to produce a differential speed which causes a variation in the meshing diameters of a pair of said pairs of gears, whereupon an intermittent rotary movement of a predetermined pitch is obtained from the intermittent dwell-and-move action of the drive shaft; and linking means coacting with said feeding means for further feeding the intermittent rotary motion to the rotary die head.

2. The combination as set forth in claim 1 wherein the epicyclic train of gears in said intermittent rotary feeding means includes:

a rotary wheel, which is fixed with one cam gear of said one pair of cam gears and which includes at least two extending shafts;

a plurality of planet gears pivotally fixed on said extending shafts of the rotary wheel by bearing means;

a sun gear meshed with said planet gears, said sun gear being fixed on the driven shaft; and a ring gear fixed with a cam gear or spur gear of the other pair of gears respectively.

3. The combination as set forth in claim 1 wherein the epicyclic train of gears in said intermittent rotary feeding means includes a first bevel gear fixed with one cam gear of one pair of cam gears and pivotally fixed with one driven shaft by bearings; a bevel-shaped rotary wheel fixed to one gear of the other pair of cam or spur gears and also pivotally fixed with the other driven shaft by means of bearings, said bevel-shaped rotary wheel further having at least two extending shafts to pviot a second bevel gear, one side of said second bevel gear being meshed with the bevel portion of said second driven shaft and the other side of which is meshed with said first bevel gear.

4. The combination as set forth in claim 1, in which a pair of meshing bevel gears are separately keyed on the respective end of the eccentric shaft which extends outside of the main body of the machine, and a drive shaft is positioned between supporting brackets integrally provided at the lateral wall of the main body of the machine by means of one set of bearings so that the driven shaft is also positioned on the supporting brackets by means of the other set of bearings.

5. The combination as set forth in claim 3 in which a pair of meshing bevel gears are separately keyed on the respective end of the eccentric shaft which extends outside of the main body of the machine, and a drive shaft is positioned between supporting brackets integrally provided at the lateral wall of the main body of the machine by means of one set of bearings so that the driven shaft is also positioned on the supporting brackets by means of the other set of bearings.

* * * * *